US005601781A

United States Patent [19]

Miller et al.

[11] Patent Number: 5,601,781

[45] Date of Patent: Feb. 11, 1997

[54] CLOSE-COUPLED ATOMIZATION UTILIZING NON-AXISYMMETRIC MELT FLOW

[75] Inventors: Russell S. Miller, Ballston Spa; Steven A. Miller, Amsterdam; Lawrence A. Wojcik, Ballston Lake, all of N.Y.

[73] Assignee: General Electric Company, Schenectady, N.Y.

[21] Appl. No.: 415,914

[22] Filed: Jun. 22, 1995

[51] Int. Cl.[6] ..... B22F 9/08

[52] U.S. Cl. ..... 266/202; 222/603; 425/7

[58] Field of Search ..... 266/200, 202; 222/603; 425/7

[56] References Cited

U.S. PATENT DOCUMENTS

| | | | |
|---|---|---|---|
| 4,401,609 | 8/1983 | McGarry et al. | 264/11 |
| 4,485,834 | 12/1984 | Grant | 425/7 |
| 4,619,597 | 10/1986 | Miller | 425/7 |
| 4,626,278 | 12/1986 | Kenney et al. | 266/202 |
| 4,631,013 | 12/1986 | Miller | 425/7 |
| 4,801,412 | 1/1989 | Miller | 425/7 |
| 4,946,082 | 8/1990 | Brun et al. | 222/593 |
| 4,966,201 | 10/1990 | Svec et al. | 222/591 |
| 4,978,039 | 12/1990 | Brun et al. | 222/592 |
| 4,993,607 | 2/1991 | Brun et al. | 222/590 |
| 5,004,629 | 4/1991 | Svec et al. | 427/204 |
| 5,011,049 | 4/1991 | Borom et al. | 222/590 |
| 5,022,150 | 6/1991 | Brun et al. | 29/890.053 |
| 5,048,732 | 9/1991 | Borom et al. | 222/606 |
| 5,244,369 | 9/1993 | Miller et al. | 425/7 |
| 5,289,975 | 3/1994 | Miller et al. | 239/79 |
| 5,310,165 | 5/1994 | Benz et al. | 266/202 |
| 5,325,727 | 7/1994 | Miller et al. | 73/861.61 |
| 5,346,530 | 9/1994 | Miller et al. | 75/331 |
| 5,366,204 | 11/1994 | Gigliotti et al. | 266/202 |

FOREIGN PATENT DOCUMENTS

| | | | |
|---|---|---|---|
| 608363 | 11/1960 | Canada | 266/202 |
| 1291287 | 2/1987 | U.S.S.R. | 425/7 |

OTHER PUBLICATIONS

"Atomization of Melts for Powder Production and Spray Deposition," Andrew J. Yule and John J. Dunkley, Oxford Series on Advanced Manufacturing, 1994, pp. 172–179.

*Primary Examiner*—George Wyszomierski
*Attorney, Agent, or Firm*—William H. Pittman

[57] ABSTRACT

Close-coupled atomization systems and methods employing axisymmetric fluid flow and non-axisymmetric melt guide tube exit orifice configuration have demonstrated superior efficiency in the production of fine superalloy powder, such as, for example, nickel base superalloys compared to conventional close-coupled atomization utilizing an axisymmetric annular gas orifice and an axisymmetric guide melt guide tube exit orifice configuration.

16 Claims, 7 Drawing Sheets

CLOSE-COUPLED ATOMIZATION UTILIZING NON-AXISYMMETRIC MELT FLOW

RELATED APPLICATIONS

This application is related to commonly assigned U.S. patent application Ser. No. 08/338,995, (RD-21,205), of Miller et al., filed Nov. 14, 1994, and U.S. patent application Ser. No. 08/415,833 (RD-21,206) of Miller et al., and U.S. patent application Ser. No. 08/415,834 (RD-21,208) of Miller et al., filed concurrently herewith, the disclosure of each is hereby incorporated by reference.

BACKGROUND OF THE INVENTION

The present invention relates generally to closely coupled gas atomization of metals. More particularly, it relates to close-coupled atomization systems and methods of operation of such systems for preparing metal powders which result in increased yields of fine particles. Most particularly, it relates to methods, apparatus and systems for utilization of non-axisymmetric melt flow to result in the efficient atomization of metals, specifically superalloys.

The development of atomization systems having fluid, such as gas atomization nozzles, for the production of metallic powders started with remote gas jets, or metal freefall designs, and more recently evolved to close-coupled designs in the quest for greater efficiency and increased yields of fine powder. Many of the early remote jet designs employed a small number of individual gas jets. As the designs matured, the number of jets increased until the limiting case of an annular jet was employed. Almost universally, (see U.S. Pat. No. 4,401,609), the technology moved toward the application of axisymmetric melt and axisymmetric gas flows for fine powder efficiency improvements. The knowledge base regarding axisymmetric melt and axisymmetric gas flows generated with remote gas jets was carried over into the design of early close-coupled atomization systems. During early efforts to increase fine powder yields, gas plenum designs received much attention in order to ensure a high degree of gas flow symmetry. For a detailed discussion of the history of the atomization of melts, both axisymmetric and asymmetric (non-axisymmetric), see "Atomization of Melts for Powder Production and Spray Deposition," A. J. Yule and J. J. Dunkley, Oxford University Press, 1994, the disclosure of which is hereby incorporated by reference.

While close-coupled or closely coupled metal atomization is a relatively new technology, methods and apparatus for the prior practice of close-coupled atomization are set forth in commonly owned U.S. Pat. Nos. 4,619,597; 4,631,013; 4,801,412; 4,946,082; 4,966,201; 4,978,039; 4,993,607; 5,004,629; 5,011,049; 5,022,150; 5,048,732; 5,244,369; 5,289,975; 5,310,165; 5,325,727; 5,346,530 and 5,366,204, the disclosures of each is incorporated herein by reference. Among other things, these patents disclose the concept of close coupling, i.e., to create a close spatial relationship between the point at which a melt stream emerges from a melt guide tube orifice and a point at which a gas stream emerges from a gas nozzle orifice to impact or intersect the melt stream and interaction therewith to produce an atomization zone. Conventional close-coupled atomization systems typically included axisymmetric melt guide tube exit orifices with either annular gas nozzle orifices or multiple discreet gas jets.

Because known prior attempts to operate closely coupled atomization apparatus resulted in many failures due to the many problems which were encountered, most of the prior art, other than those mentioned above, for atomization technology concerned remotely coupled apparatus and practices, the technology disclosed by the above referenced patents is believed to be one of the first, if not the first, successful closely coupled atomization systems to be developed that had potential for commercial operation.

For a metal atomization processing system, accordingly, the higher the percentage of the finer particles which are produced the more desirable the properties of the articles formed from such fine powder by conventional powder metallurgical techniques. For these reasons, there is a strong economic incentive to produce higher and higher yields of finer particles through atomization processing.

As pointed out in the commonly owned patents above, the close-coupled atomization technique results in the production of powders from metals having high melting points with higher concentration of fine powder. For example, it was pointed out therein that by the remotely coupled technology only about 3% of powder produced industrially is smaller than 10 microns and the cost of such powder is accordingly very high. Fine powders of less than 37 microns in diameter of certain metals are used, for example, in low pressure plasma spray applications. In preparing such fine powders by remotely coupled techniques, as much as about 60% to about 75% of the resulting powder must be scrapped because it was oversized. The need to selectively separate out and keep only the finer powder and to scrap the oversized powder increases the cost of producing usable fine powder.

Further, the production of fine powder is influenced by the surface tension of the melt from which the fine powder is produced. High surface tension melts increase the difficulty in producing the fine powder and, thus, consume more gas and energy.

A major cost component of fine powder prepared by atomization and useful in industrial applications is the cost of the gas used in the atomization. The gas consumed in producing powder, particularly the inert gas such as, for example, argon, is expensive. Thus, it is economically desirable to be able to produce a higher percentage of fine powder particles using the same amount of gas.

As is explained more fully in the commonly owned patents referred to above, the use of the close-coupled atomization technology resulted in the formation of higher concentrations of finer particles than was available through the use of prior remotely coupled atomization techniques.

With rare exception, for both close-coupled and remote atomization systems, designers have attempted to maintain an axisymmetric relationship between the melt flow and the gas flow. Most often, this was accomplished by using a circular melt stream surrounded by an annular, circular gas jet or a circular array of individual gas jets. Some linear atomizers have been reported using a long thin rectangular slit for the melt orifice (see U.S. Pat. No. 4,401,609). But even here the gas jet geometry is designed to provide a uniform melt spray pattern along the long axis of the slit. Only one remote atomizing nozzle and one non-axisymmetric close-coupled atomizing nozzle are known to have existed prior to the non-axisymmetric system disclosed herein (see U.S. Pat. Nos. 4,631,013 and 4,485,834). Few, if any, non-axisymmetric melt guide tube exit orifices or gas orifice configurations are believed to have been proposed in order to achieve higher yields of fine particles.

While the early close-coupled atomization systems increased the yields of fine powder relative to the metal free fall remotely coupled system, there is a continuing industrial demand for additional increased yields of ultra fine metal powders, e.g., powders having a particle diameter smaller than 37 microns. Accordingly, there is a need to develop metal atomization systems and methods which can increase the yield of such ultra fine powder and narrow the distribution of particle sizes formed and do so with increased efficiency and lower cost. Any resulting system should produce improved fine powder yields while being compatible with at least one and preferably both low and high melt superheat metal processing systems.

SUMMARY OF THE INVENTION

In carrying out the present invention in preferred forms thereof, we provide improved close-coupled atomization systems and methods for metal atomization which includes non-axisymmetric melt guide tube exit orifice configurations for making powders having a particle diameter smaller than 37 microns. Illustrated embodiments of the resulting atomization systems which include non-axisymmetric melt guide tube exit orifice configurations for making powders having a particle diameter smaller than, for example, 37 microns are disclosed herein.

A specific example of the present invention includes a close-coupled non-axisymmetric atomization system for atomizing molten metal comprising: plenum means having a channel therein for delivering at least one fluid; a melt guide tube extending axially through the plenum to an exit orifice having a non-axisymmetric configuration, the plenum means including means for supporting the melt delivery tube; and a melt guide tube extending axially through the plenum to an exit orifice having a non-axisymmetric configuration, the plenum means including means for supporting the melt delivery tube, the non-axisymmetric configuration of the melt guide tube exit orifice providing for the interaction of the delivered at least one fluid with the molten metal at a point proximate the melt guide tube exit orifice.

Another specific example of the present invention includes apparatus for atomizing liquid metal comprising: a liquid metal supply; a fluid nozzle for atomizing a stream of liquid metal from the liquid metal supply in an atomization zone extending from the fluid nozzle; and a melt guide tube having an non-axisymmetric configured exit orifice, the non-axisymmetric configuration of the melt guide tube exit orifice providing for the interaction of the delivered at least one fluid with the molten metal at a point proximate the melt guide tube exit orifice.

Still another specific example of the present invention includes a system for the close-coupled atomization of liquid metal in an enclosure, the system comprising: a crucible; a fluid nozzle operatively positioned in the enclosure; a melt guide tube operatively connected to the crucible and operatively positioned relative to the fluid nozzle; a plenum, operatively connected to the fluid nozzle and operatively positioned relative the melt guide tube for providing at least one atomizing fluid to the fluid nozzle; and a non-axisymmetric melt guide tube exit orifice, operatively formed in the melt guide tube, for providing non-axisymmetric melt flow to interact with the at least one fluid at a point proximate the melt guide tube exit orifice.

Accordingly, an object of the present invention is to provide atomization systems and atomization methods for providing increased yields of metal powder having a particular diameter of at least 37 microns.

A further object of the present invention is to provide atomization systems and methods which provides improved yields of fine powders and is compatible with both low and high melt superheat metal processing systems.

Other objects and advantages of the invention will be apparent from the following description, the accompanying drawings and the appended claims.

DESCRIPTION OF THE PREFERRED EMBODIMENTS AND METHODS

As part of a continuing atomization system development effort to achieve high yields for fine powder, which emphasized axisymmetric annular gap type gas nozzle and axisymmetric melt guide tube exit orifice configurations non-axisymmetric configuration and their effects have now been studied. These non-axisymmetric geometry effects range from subtle gas distribution changes in the gas plenum to extreme non-axisymmetry in the melt delivery nozzle. These studies were motivated by an attempt to understand yield variability in axisymmetric close-coupled atomization systems and a parallel search for close-coupled atomization system configurations, both close-coupled gas atomization nozzles and melt guide tube exit orifices, compatible with both low and high melt superheat processing which would result in improved yields of fine powder.

The studies conducted indicated that non-axisymmetric gas flow and/or non-axisymmetric melt flow in close-coupled atomization systems can be superior to axisymmetric gas flow and axisymmetric melt flow for the production of fine powder. It is now recognized that a commonalty in physical mechanisms apply to both types of non-axisymmetric flow. A good definition for non-axisymmetric melt flow is the condition existing at any time the periphery ratio (circumference of shape/circumference of circle of equal area) is greater than one (1.0), or where the axis of the melt orifice and the axis of the gas orifice are not concentric.

Figure 1:
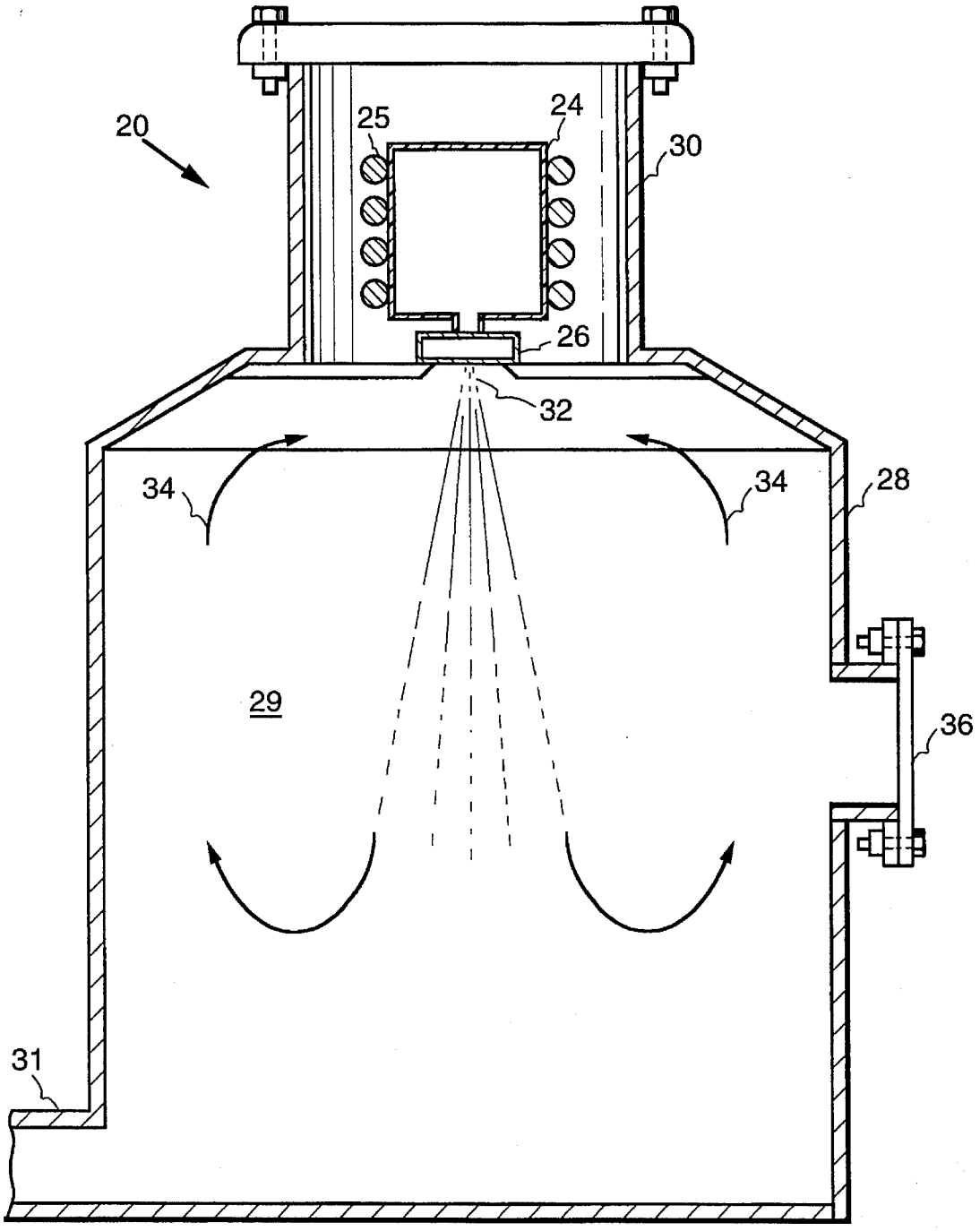
FIG. 1 is a schematic side view of a representative atomization system for atomizing molten metal.

First, prior to discussing the details of the present invention, two representative prior atomization systems will be described. A representative high melt superheat close-coupled atomization system is illustrated as generally designated by the numeral 20 in FIG. 1. As can be seen, the system 20 comprises a crucible 24, a nozzle 26, and an enclosure 28. The crucible 24 is formed of suitable material for holding the liquid metal, e.g. ceramic such as alumina or zirconia, or water cooled copper. A conventional heating means such as element 25 can be positioned for heating the molten metal therein. The molten metal in crucible 24 can be heated by any suitable means, such as an induction coil, plasma arc melting torch, or a resistance heating coil. The crucible 24 has a bottom pouring orifice coupled with a melt guide tube in nozzle 26. The crucible 24, and nozzle 26 are conventionally mounted on atomization enclosure 28.

The atomization enclosure 28, formed from a suitable material, such as, for example, steel is configured to provide an inner chamber 29 suitable for containing the atomization process. Depending upon the metal being atomized, enclosure 28 can contain an inert atmosphere or vacuum. A suitable crucible enclosure 30 can be formed over the crucible 24 to contain an inert atmosphere for the liquid metal. A conventional vacuum pump system, not shown, or gas supply means, not shown, are coupled with atomization enclosure 28 and crucible enclosure 30 to provide the inert atmosphere or vacuum therein. A conventional exhaust system, not shown, for example with cyclone separators, is coupled with enclosure 28 at connection 31 to remove the atomized powder during the atomization process.

A stream of liquid metal from crucible 24 is atomized by the nozzle 26, forming a plume (such as an axisymmetric plume, the cross section of which is a circle) of molten metal droplets 32 which are rapidly quenched to form solid particulates of the metal. Prior Art close-coupled nozzles are shown, for example, in U.S. Pat. Nos. 4,801,412, 4,780,130, 4,778,516, 4,631,013, and 4,619,845. The nozzle 26 directs a stream of liquid metal into a converging supersonic jet of atomizing gas. The high kinetic energy of the supersonic atomizing gas breaks up the stream of liquid metal into atomized droplets which are widely dispersed in the atomization enclosure. As a result, within several seconds of the initiation of atomization, the atomization vessel is filled with a cloud of recirculating powder particulates, for example shown by arrows 34. While atomization of the liquid metal stream can be viewed at the initiation of atomization, for example from view port 36 mounted on atomization enclosure 28, the interaction between the atomizing gas jet and the liquid metal stream is obscured by the cloud of metal particulates within a few seconds.

Figure 2:
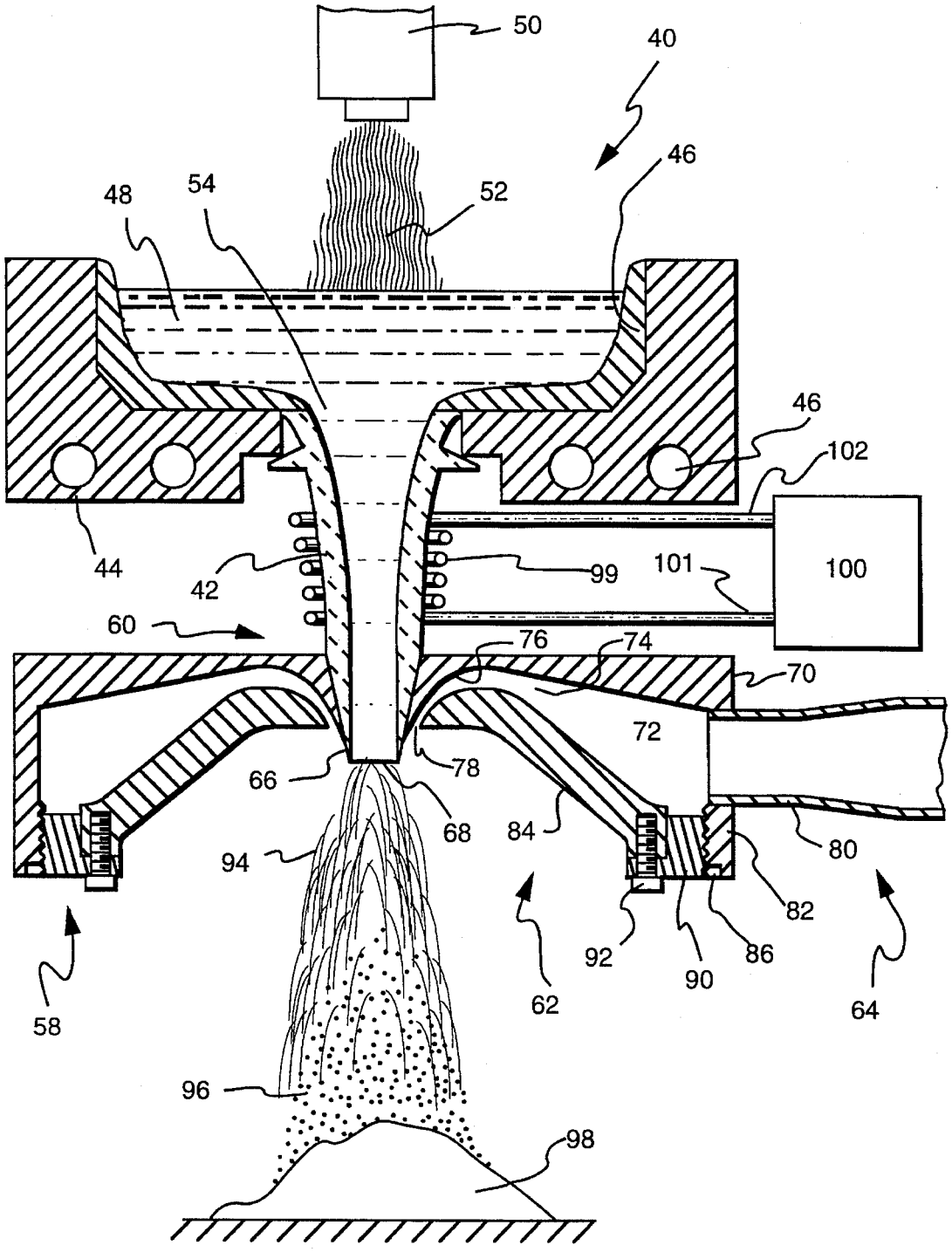
FIG. 2 is a sectional view of a cold hearth apparatus operatively linked to an induction heated melt guide tube and to shallow close-coupled nozzle atomization apparatus.

FIG. 2 illustrates a representative close-coupled atomization system compatible with low melt superheat metal processing. The system, as illustrated, is described in commonly assigned U.S. Pat. No. 5,366,204 issued Nov. 22, 1994.

As described therein, a melt supply reservoir and a melt guide tube are shown semischematically. The melt is supplied from a cold hearth apparatus 40 which is illustrated undersize relative to a melt guide tube 42. The cold hearth apparatus includes a copper hearth or container 44 having water cooling passages 46 formed therein. The water cooling of the copper container 44 causes the formation of a skull 46 of frozen metal on the surface of the container 44, thus, protecting the copper container 44 from the action of the liquid metal 48 in contact with the skull 46. A heat source 50, which may be, for example, a plasma gun heat source, having a plasma flame 52 directed against the upper surface of the liquid metal of molten bath 48, is disposed above the surface of the cold hearth apparatus 40. The liquid metal 48 emerges from the cold hearth apparatus through a bottom opening 54 formed in the bottom portion of the copper container 44 of the cold hearth apparatus 40. Immediately beneath the opening 54 from the cold hearth, a melt guide tube 42 is disposed to receive melt descending from the reservoir of metal 48. The tube 42 is illustrated oversize relative to hearth 40 for clarity of illustration.

The melt guide tube 42 is positioned immediately beneath the copper container 44 and is maintained in contact therewith by mechanical means, not shown, to prevent spillage of molten metal emerging from the reservoir of molten metal 48 within the cold hearth apparatus 40. The melt guide tube 42 may be, for example, a ceramic structure or any structure which is resistant to attack by the molten metal 48. Melt guide tube 42 may be formed of, for example, boron nitride, aluminum oxide, zirconium oxide, or any other suitable ceramic material or other suitable material compatible with the metal atomization process. The molten metal flows down through the melt guide tube to the lower portion thereof from which it can emerge as a stream into an atomization zone.

Melt passes down through the melt guide tube and is atomized by a close-coupled atomization apparatus 58 which is more fully described in copending applications Ser. No. 07/920,075, filed Jul. 27, 1992; and Ser. No. 07/920,066, filed Jul. 27, 1992, the disclosures of each are herein incorporated by reference.

As shown, there are three structural elements in the atomization structure of FIG. 2. The first is a central melt guide tube structure 60. The second is the gas atomization structure 62, and the third is the gas supply structure 64.

The melt supply structure 60 is essentially the lower portion of the melt guide tube structure 42. The melt guide tube is a structure which ends in an inwardly tapered lower end 66, terminating in a axisymmetric melt orifice 68. The axisymmetric gas atomization structure 62 includes a generally low profile housing 70 which houses a plenum 72 positioned laterally at a substantial distance from the melt guide tube 60. The atomizing gas from plenum 62 passes generally inwardly and upwardly through a narrowing neck passageway 74 into contact with a gas shield portion 76 where the gas is deflected inward and downward to the orifice 78 and from there into contact with melt emerging from the melt orifice 68.

The plenum 62 is supplied with gas from a gas supply, not shown, through the gas supply structure 64, such as a pipe. Pipe 64 has necked down portion 80 where it is attached to the wall 82 of the housing 70. The lower portion of plenum 62 is a shaped adjustable annular structure 84 having a threaded outer ring portion 86 by which threaded vertical movement is accomplished. Such movement is accomplished by turning the annular structure 84 to raise or lower it by means of the threads at the rim of ring 86 thereof. A ring structure 90 is mounted to annular structure 84 by conventional means such as bolt 92.

The gas atomized plume 94 of molten metal passes down to a region where the molten droplets solidify into particles 96 and the particles may accumulate in a pile 98 in a receiving container.

The present invention resulted from attempts to further increase fine powder yields by perfecting the axisymmetry of the gas flow from the gas nozzle to the melt in close-coupled atomization systems similar to those described above. In conjunction with this effort, fluid dynamic experts were consulted for improving the axisymmetric gas flow/melt flow in close-coupled atomization systems.

Specifically, when fluid dynamic experts were consulted concerning increasing the yields of fine powder for close-coupled atomization systems, such as those described above, they recommended significantly increasing the gas volume of the gas plenum. This recommendation was based upon the understanding that increasing the yields of fine powder was directly related to the degree of axisymmetric gas flow that was delivered from the gas plenum to the atomization zone. In other words, if it were true that the yields of fine powder were directly related to the degree of axisymmetric gas flow that was delivered to the atomization zone, then a plenum which delivered a pure (100%) axisymmetric gas flow to the atomization zone would produce the highest yields of fine powder. Since, in their opinion, the relatively small volume plenum of the initial close-coupled nozzle designs had considerable room for improvement with regard to more closely approaching pure axisymmetric gas flow, it was decided that the gas plenum volume should be increased to ensure that there were little, if any, pressure gradient differences between different locations around the nozzle orifice. It was thought that such a uniform situation would surly result in higher yields of fine powder and most likely the highest yields of fine powder possible. At this time, little attention was paid the melt stream shape, which had also typically been an axisymmetric circle.

It has now been found that the systems and methods of the present invention provide an improved yield of fine particles during atomization as compared to the yields realized from the above described systems or the remotely coupled systems. For example, utilizing systems of the present invention, a nickel based superalloy powder having a particle size of about 37 microns or less can be formed with a yield of up to about seventy (70) percent to about eighty (80) percent as compared to yields of up to about forty (40) percent to about sixty (60) percent fine yields obtained from close-coupled fully axisymmetric systems.

Figure 3B:
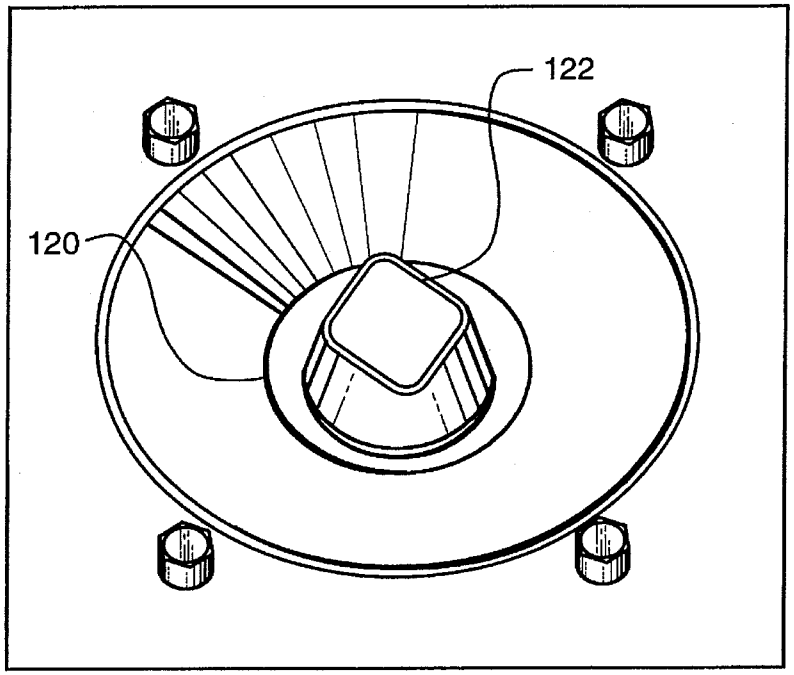
FIG. 3*b* is a partial perspective view of a non-axisymmetric gas flow nozzle including the exterior of the melt guide tube surfaces along with a non-axisymmetric square nozzle.
Figure 3A:
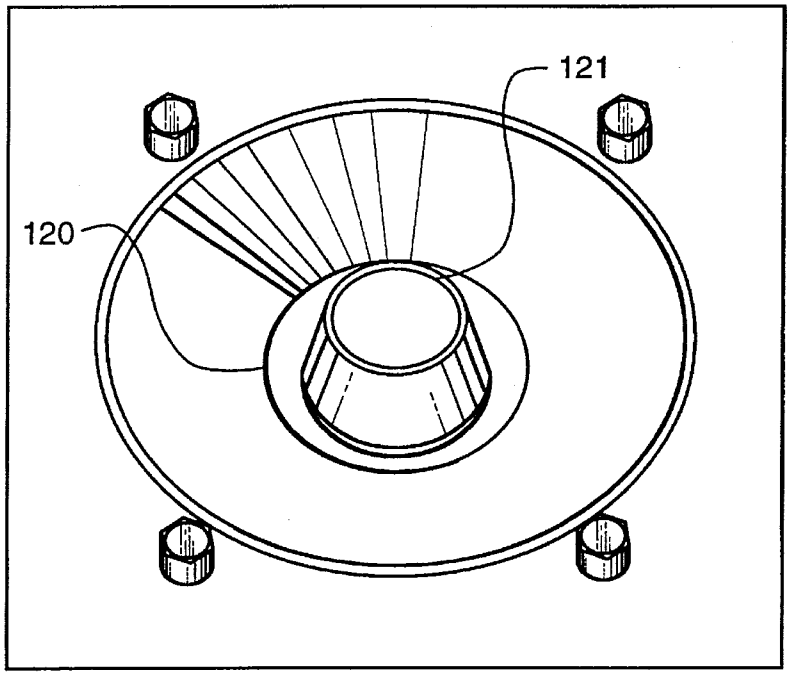
FIG. 3*a* is a partial perspective view of a prior art axisymmetric fluid nozzle and a prior art axisymmetric circular cross section melt guide exit tube.

A bottom view of both a typical axisymmetric and a high yield non-axisymmetric system, which may incorporate both non-axisymmetric fluid, such as, for example, gas or liquid flow geometries and non-axisymmetric melt guide tube exit orifice configuration is shown in FIGS. 3*a* and 3*b*, respectively. As illustrated in FIG. 3*a*, a circular gas orifice 120 surrounds a circular, axisymmetric cross section melt guide tube exit orifice 121. As illustrated in FIG. 3*b*, a complex shaped melt guide tube 122 transitions from an approximately circular cross section to an approximately square cross section at a point between the melt supply apparatus and the melt guide tube exit point. Depending on where the transition from circular to square cross section occurs, as will explained later, the fluid, in this case gas, orifice may produce either axisymmetric or non-axisymmetric gas flow to the atomization zone.

FIG. 3*b* depicts a fully non-axisymmetric close-coupled nozzle that utilizes both non-axisymmetric melt flow and non-axisymmetric gas flow. During the experiment which led to the discovery of the importance of non-axisymmetric gas flow and melt flow, both non-axisymmetric effects were always incorporated because the configuration of the melt guide tube tip that produces non-axisymmetric gas flow naturally lead to the use of a non-axisymmetric melt guide tube orifice. However, in an attempt to identify the relative importance of these two non-axisymmetric effects, melt guide tube, gas orifice and melt exit orifice configurations were designed that incorporated each type of non-axisymmetry flow, either in the gas flow or the melt flow alone.

Figure 4A:
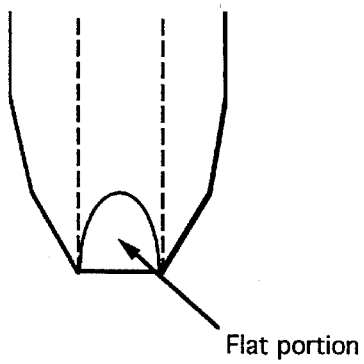
FIGS. 4*a* and 4*b* are schematics of a square non-axisymmetric melt guide tube exit orifice and a non-axisymmetric contoured exterior.
Figure 4B:
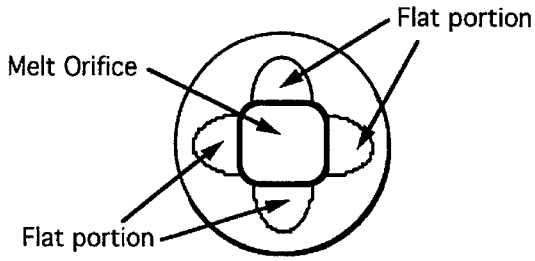
Figure 4C:
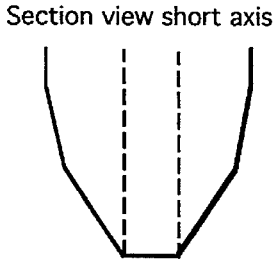
FIGS. 4*c*, 4*d*, 4*e* and 4*f* are schematics of a planar non-axisymmetric melt guide tube exit orifice and non-axisymmetric contoured exterior.
Figure 4D:
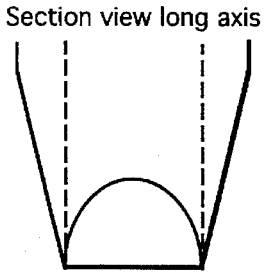
Figure 4E:
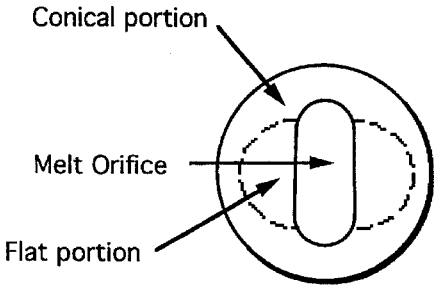
Figure 4F:
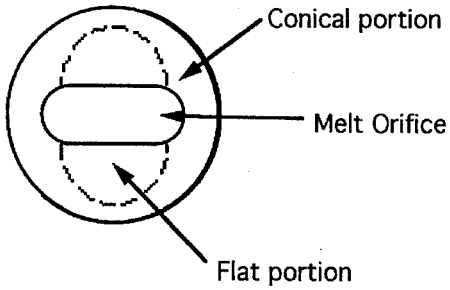

FIGS. 4*a* and 4*b* illustrate the general tip configuration of the square melt guide tube shown in the non-axisymmetric close-coupled system of FIG. 3*b*. The exterior surface of the melt guide tube has flats cut into it to create non-axisymmetric gas flow. Also, since the melt exit orifice is square, the melt delivered to the atomization zone flows in a non-axisymmetric square configuration. Thus, the melt guide tube of FIG. 4*a* produces both non-axisymmetric melt flow and non-axisymmetric gas flow. Additionally, FIGS. 4*c*, 4*d*, 4*e*, and 4*f* show, as a further example, a planar melt guide tube geometry that also produces both non-axisymmetric melt flow and non-axisymmetric gas flows.

Figure 5A:
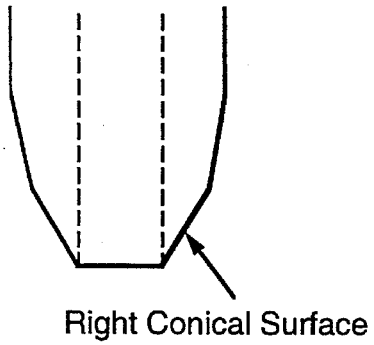
FIGS. 5*a* and 5*b* are schematics of a square non-axisymmetric melt guide tube exit orifice with an axisymmetric exterior.
Figure 5B:
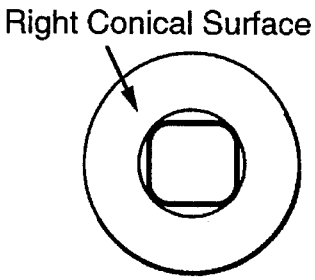
Figure 5C:
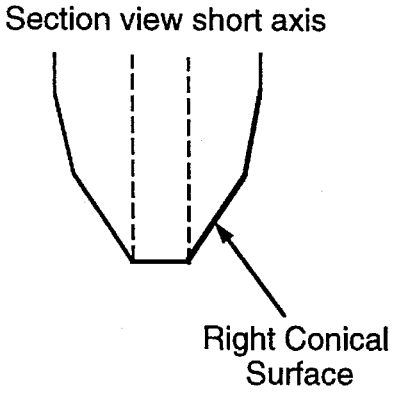
FIGS. 5*c*, 5*d*, 5*d* and 5*f* are schematics of a planar non-axisymmetric melt guide tube with an axisymmetric exterior.
Figure 5D:
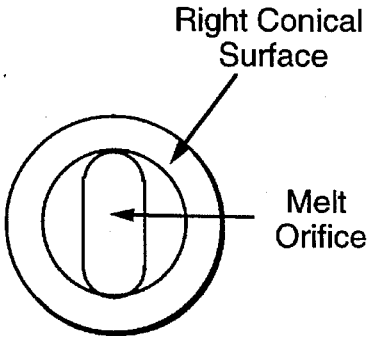
Figure 5E:
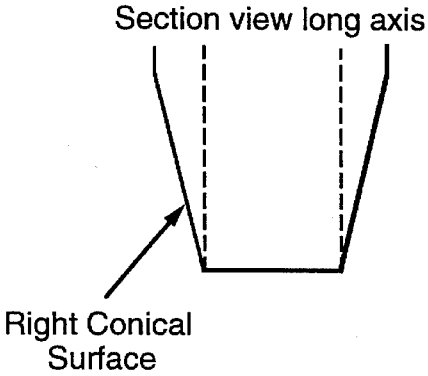
FIGS. 5*g* and 5*h* are schematics of a star shaped non-axisymmetric melt guide tube exit orifice with an axisymmetric exterior.
Figure 5F:
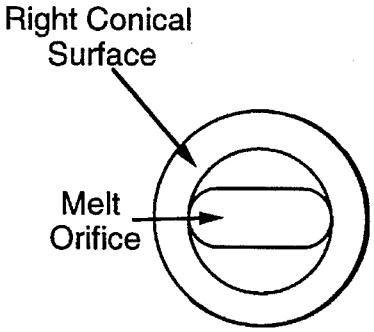
Figure 5G:
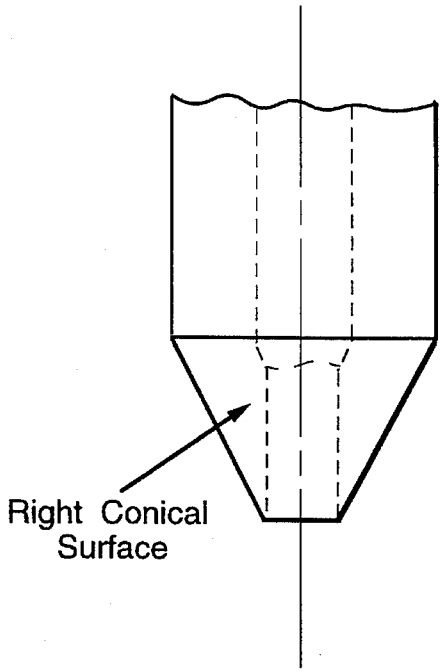
Figure 5H:
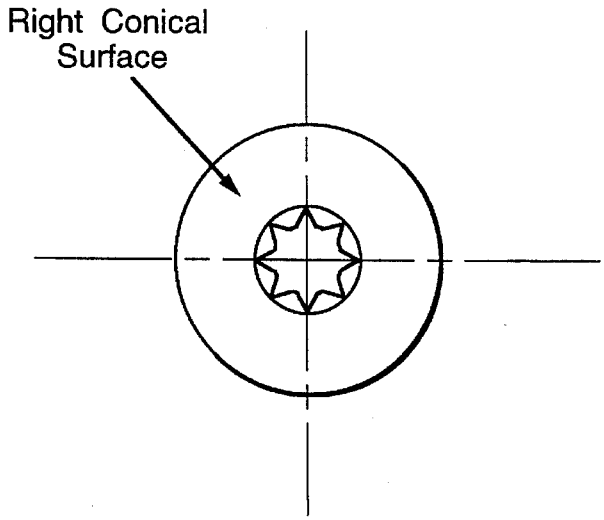

FIGS. 5*a–h* are examples of melt guide tube configurations that provide non-axisymmetric melt flow and axisymmetric gas flow. The external surface of the tube tip is a simple right frustum which provides a completely axisymmetric gas flow to the atomization zone, while only the melt exit orifice is non-axisymmetric. Three versions are shown, one in which the melt orifice is a square (FIGS. 5*a* and 5*b*), one in which the melt orifice is a thin strip (planar, FIGS. 5*c*, 5*d*, 5*e*, and 5*f*), and one where the melt orifice is an eight pointed star (FIG. 5*c*).

Figure 6:
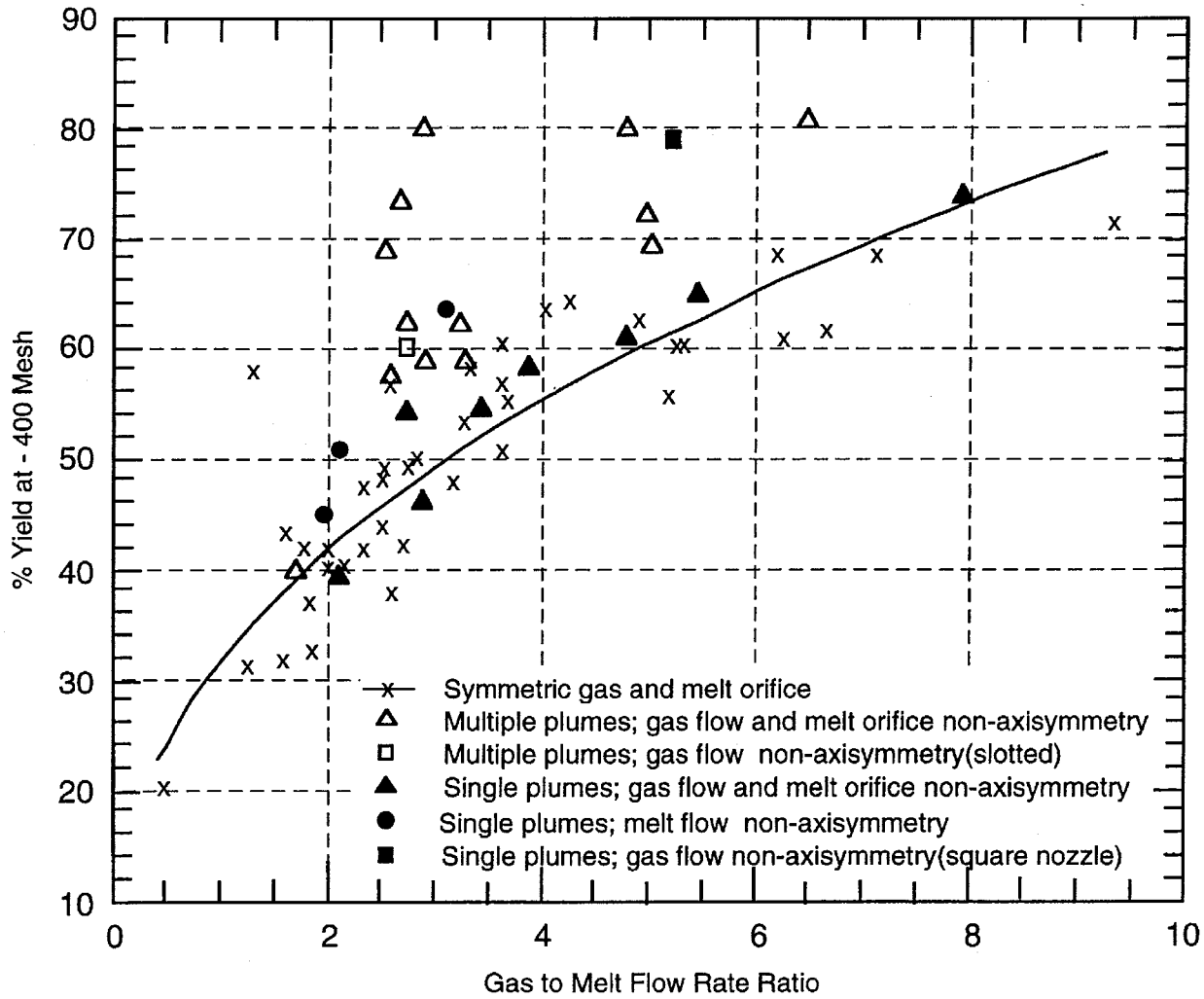
FIG. 6 is a graph which shows the –400 mesh nickel base superalloy powder from a plurality of non-axisymmetric configurations compared to a band of the best axisymmetric atomization system configurations.

The results of atomizing nickel base superalloys using these non-axisymmetric melt orifice configurations as well as many other non-axisymmetric gas flow and melt flow configuration are shown in FIG. 6.

From viewing FIG. 6, it should be clear that the use of both non-axisymmetric gas flow and non-axisymmetric melt flow, as a whole, produces far more efficient atomization and higher yields of fine powder than axisymmetric gas flow and axisymmetric melt flow, especially at low gas to metal ratios. The use of non-axisymmetrical melt flow alone, i.e. no non-axisymmetry in the gas flow, is not as efficient as with both non-axisymmetric gas flow and non-axisymmetric melt flow, but still produces a higher yield of fine powder than does axisymmetric melt flow and axisymmetric gas flow.

That non-axisymmetric melt flow improved the yield of fine power and, thus, the atomization process was a surprise, as it was previously believed that the momentum of the gas flow field completely dominated the atomization process. It is possible that the non-axisymmetric melt exit orifice aids the re-entrant gas jet in allowing the melt to be distributed preferentially to the external corners of the melt orifice. While this might be expected to produce a non-symmetrical plume and/or metal web right in the vicinity of the melt orifice, this was not observed experimentally. Thus, the mechanism that produces the improved yield of fine powder is still a matter of conjecture, although the data of FIG. 6 shows non-axisymmetry in the melt flow alone clearly improves atomization.

Quantifying the impact of the non-axisymmetric effect in the melt flow has proven quite difficult and it is believed not sufficiently described by the use of planes of symmetry. Hence, the ratio of the periphery to the circumference of a circle of equal area and by the ratio of the major and minor axis of the orifice shape has been chosen as the means of description. FIG. 7 shows these values for an axisymmetrical melt orifice and the non-axisymmetric melt orifices tested. Yield improvement were observed when the periphery dimension was about 10% to about 50% larger than the equivalent area circle and the ratio of the major and minor axis was in the range of about 1.3 to about 1.4.

It should be noted that no attempt has been made to identify the minimum values of the non-axisymmetric parameters that would be operative. FIG. 7 only shows the value that were tested. It is believed that other parameter values would work and would produce higher yields of the powder than axisymmetric gas orifices and axisymmetric melt exit orifices produce.

FIG. 6 illustrates the –400 mesh yield of nickel base superalloy powder from many non-axisymmetric configuration compared to a band of the best axisymmetric configuration comprising hundreds of tests. As can be seen, the resulting yield of fine powders is definitively improved for the best non-axisymmetric system configuration as compared to axisymmetric system configuration.

As shown, all experimental runs in which the close-coupled system utilized non-axisymmetric gas and melt flow show increased yields of fine powder, especially in the two (2) to six (6) gas to melt flow rate ratio range. As is known, the lower the gas to melt flow rate ratio, the less gas is used in

TABLE 1

| RUN # | NON-AXI | NOZZLE GEOMETRY | Gas Momentum Flux: Conical Surface RA-DIAL COMP | Gas Momentum Flux: Conical Surface AXIAL COMP | Gas Momentum Flux: Flat Surface RA-DIAL COMP | Gas Momentum Flux: Flat Surface AXIAL COMP | (A) RATIO RA-DIAL COMP | (A) RATIO AXIAL COMP | Gas Mass Flow Rate: LOC MASS FR CONE | Gas Mass Flow Rate: LOC MASS FR FLAT | Gas Mass Flow Rate: (A) LOC MASS FR RATIO | Gas Flow W-LENGTH (B) NOZZLE TIP | Gas Flow W-LENGTH (B) G GASS ORIFICE | MAJOR AXIS | MINOR AXIS | RA-TIO | Melt Flow P-RATIO |
|---|---|---|---|---|---|---|---|---|---|---|---|---|---|---|---|---|---|
| 750 | G & M | P MGT, Non-Axi GO | 0.375 | 0.927 | 0.5 | 0.866 | 1.33 | 1.07 | 0.013 | 0.025 | 2 | 0.332 | 0.604 | 0.245 | 0.125 | 1.96 | 1.09 |
| 751 | G & M | P MGT, Annular GO | 0.250 | 0.968 | 0.545 | 0.839 | 2.18 | 1.15 | 1 | 1 | 1 | 0.332 | — | 0.245 | 0.125 | 1.96 | 1.09 |
| 752 | G & M | P MGT, Non-Axi GO | 0.375 | 0.927 | 0.545 | 0.839 | 1.45 | 1.1 | 0.013 | .032 | 2 | 0.332 | 0.640 | 0.245 | 0.125 | 1.96 | 1.09 |
| 755 | G & M | SPMGT, Annular GO | 0.250 | 0.968 | 0.545 | 0.839 | 2.18 | 1.15 | 1 | 1 | 1 | 0.332 | — | 0.245 | 0.125 | 1.96 | 1.09 |
| 756 | G & M | S MGT, Annular GO | 0.250 | 0.968 | 0.438 | 0.899 | 1.75 | 1.08 | 1 | 1 | 0.2 | 0.27 | — | 0.28 | 0.25 | 1.41 | 1.13 |
| 769 | G & M | P MGT, Annular GO | 0.252 | 0.967 | 0.545 | 0.839 | 2.16 | 1.15 | 1 | 1 | 1 | 0.332 | — | 0.24 | 0.12 | 2 | 1.09 |
| 770 | G & M | P MGT, Annular GO | 0.252 | 0.967 | 0.545 | 0.839 | 2.16 | 1.15 | 1 | 1 | 1 | 0.332 | — | 0.24 | 0.12 | 2 | 1.09 |
| 772 | G & M | P MGT, Annular GO | 0.252 | 0.967 | 0.545 | 0.839 | 2.16 | 1.15 | 1 | 1 | 1 | 0.386 | — | 0.24 | 0.12 | 2 | 1.09 |
| 773 | G & M | S MGT, Annular GO | 0.250 | 0.968 | 0.438 | 0.899 | 1.75 | 1.08 | 1 | 1 | 1 | 0.27 | — | 0.28 | 0.25 | 1.41 | 1.13 |
| 794 | G & M | S MGT, Annular GO | 0.250 | 0.968 | 0.485 | 0.875 | 1.94 | 1.11 | 1 | 1 | 1 | 0.27 | — | 0.28 | 0.25 | 1.41 | 1.13 |
| 795 | G & M | S MGT, Annular GO | 0.250 | 0.968 | 0.407 | 0.914 | 1.63 | 1.06 | 1 | 1 | 1 | 0.27 | — | 0.28 | 0.25 | 1.41 | 1.13 |
| 796 | G & M | S MGT, Annular GO | 0.250 | 0.968 | 0.391 | 0.921 | 1.56 | 1.05 | 1 | 1 | 1 | 0.27 | — | 0.28 | 0.25 | 1.41 | 1.13 |
| 801 | G & M | S MGT, Annular GO | 0.250 | 0.968 | 0.391 | 0.921 | 1.56 | 1.05 | 1 | 1 | 1 | 0.27 | — | 0.28 | 0.25 | 1.41 | 1.13 |
| 809 | G only | Elliptical GO | 0.218 | 0.976 | 0.218 | 0.976 | 1 | 1 | 0.03 | 0.08 | 2.5 | IND | 0.73 | 0.19 | 0.19 | 1 | 1 |
| 810 | G Only | Elliptical GO | 0.218 | 0.976 | 0.218 | 0.976 | 1 | 1 | 0.03 | 0.08 | 2.5 | IND | 0.73 | 0.19 | 0.19 | 1 | 1 |
| 812 | G only | Elliptical GO | 0.216 | 0.976 | 0.216 | 0.976 | 1 | 1 | 0.03 | 0.08 | 2.5 | IND | 0.73 | 0.19 | 0.19 | 1 | 1 |
| 813 | G only | Elliptical GO | 0.220 | 0.978 | 0.220 | 0.978 | 1 | 1 | 0.03 | 0.08 | 2.25 | IND | 0.73 | 0.19 | 0.19 | 1 | 1 |
| 825 | G only | S MGT Surface | 0.250 | 0.968 | 0.515 | 0.857 | 2.06 | 1.13 | 1 | 1 | 1 | 0.54 | | 0.19 | 0.19 | 1 | 1 |
| 826 | M only | S Melt Orifice | 0.250 | 0.968 | 0.250 | 0.968 | 1 | 1 | 1 | 1 | 1 | — | — | 0.28 | 0.25 | 1.41 | 1.13 |
| 827 | M only | S Melt Orifice | 0.250 | 0.968 | 0.250 | 0.968 | 1 | 1 | 1 | 1 | 1 | — | — | 0.28 | 0.25 | 1.41 | 1.13 |
| 828 | M only | S Melt Orifice | 0.250 | 0.968 | 0.250 | 0.968 | 1 | 1 | 1 | 1 | 1 | — | — | 0.28 | 0.25 | 1.41 | 1.13 |
| 833 | M only | 8 pt. M Orifice | 0.250 | 0.968 | 0.250 | 0.968 | 1 | 1 | 1 | 1 | 1 | — | — | 0.353 | o.261 | 1.35 | 1.48 |
| 834 | G & M | P MGT, Annular GO | 0.250 | 0.968 | 0.454 | 0.891 | 1.82 | 1.09 | 1 | 1 | 1 | 0.332 | — | 0.25 | 0.13 | 2 | 1.09 |
| 836 | G only | Tang. Gas Flow | 0.374 | 0.927 | — | — | — | — | IND | IND | INF | IND | 0.73 | 0.19 | 0.19 | 1 | 1 |
| 837 | G & M | P MGT Focused GO | 0.250 | 0.968 | 0.454 | 0.891 | 1.82 | 1.09 | 0.03 | 0.12 | 4 | 0.332 | 0.9 | 0.25 | 0.13 | 2 | 1.09 |
| 838 | G only | Focused GO | 0.250 | 0.968 | 0.250 | 0.968 | | | 0.03 | 0.12 | 4 | IND | 0.9 | 0.19 | 0.19 | 1 | 1 |
| 835 | None | Symmetrical MGT | 0.250 | 0.968 | 0.250 | 0.968 | 1 | 1 | 1 | 1 | 1 | — | — | 0.19 | 0.19 | 1 | A |

GO = Gas Orifice
MGT = Melt Guide Tube
NON-AXI = Non-Axisymmetric
G & M = Gas and Melt
G only = Gas only
M only = Melt only
P MGT, = Planar Melt Guide Tube
GO = Gas Orifice
S MGT = Square Melt Guide Tube
S Melt = Square Melt 8 pt. m orifice—Eight point (star) Melt Orifice
Tang. = Tangential
Comp = Component
Loc Mass FR = Local Mass Flow Rate
FR = Flow Rate
W-Length = Wave Length
P-Ratio = Perimeter Ratio atomization. Thus, the lower the gas to melt flow rate ratio, the less expensive the fine powder produced thereby will be.

The uniqueness, as it ultimately was determined, of the initial non-axisymmetric concept was that the melt guide tube orifice and the gas orifice were individually non-axisymmetric. As described in U.S. patent application Ser. No. 08/338,995, filed Nov. 14, 1994, the result is a very broad, well dispersed, atomization plume with extreme droplet number density variation as both a function of the radial and circumferential position in the plume. This density variation can be sufficiently large so that the plume is actually subdivided, or at least appears to be subdivided, into two or more individual plumes.

EXAMPLE I

A metal atomization test of a square melt guide tube external geometry with a circular melt orifice (variable flat at the nozzle tip) and three metal atomization tests of a completely axisymmetric external geometry with a square melt guide tube bore (also a variable flat at the nozzle tip) were completed. Both geometric variants lead to improved yield (compared to axisymmetric geometries), though not as high a yield as the fully non-axisymmetric system, see FIG. 6.

Based on these tests, it was concluded that both internal and external non-axisymmetric flow geometries contributed to plume splitting and fine powder yield improvement. Also, concerning the melt guide tube exit orifice nonaxisymmetric configuration, no plume splitting was observed during atomization. Thus, the non-axisymmetry effects introduced by the melt guide tube exit orifice did not appear strong enough, on its own, to produce plume splitting during atomization and, as a result, fine powder yields were lower than when plume splitting was observed.

EXAMPLE II

Two tests incorporating non-axisymmetric gas flow with a circular melt exit orifice were conducted. In the first, the melt guide tube (MGT) had the same external shape as had been previously used with the square melt orifices; in the second, two grooves 1.3 mm¥1.3 mm (0.050 in.¥0.050 in.) were machined into the surface tangential to the melt orifice (to impart a shearing gas flow in the direction tangential to the melt stream), Both tests resulted in positive variances of approximately 15%. The results indicated that the gas flow characteristics should dominate the atomization process. Three tests of axisymmetric gas flow (conical MGT tip) with a non-axisymmetric melt flow (square melt orifice) produced unexpected variances ranging from about 5% to about 13%.

The results of the tests suggested that both non-axisymmetric melt and non-axisymmetric gas flow were effective in improving the yields of fine powder. Additionally, the non-axisymmetric effects appear to be additive, but not linearly, when the two are combined. In order to attain the full benefits of non-axisymmetry, it is necessary that the melt guide tube (MGT) tip design minimize wicking of the liquid metal up the external surface of the MGT. When metal is wicked up the external surface, the melt flow is essentially redistributed around the entire perimeter of the MGT. This redistribution and more uniform delivery of the melt may overcome the initial non-axisymmetry of the flows and results in the production of a single atomization plume. Tests which resulted in single atomization plumes have almost invariably produced lower yield variances than tests in which two or more discrete plumes were observed. Use of non-axisymmetric melt flow combined with axisymmetric gas flow produced only single atomization plumes.

Thus, it is clear from the above that the conventional wisdom relating to maintaining an axisymmetric melt flow in atomization systems was incorrect, in that the pure axisymmetric melt flow produced lower yields of fine powder than when non-axisymmetric melt flows were used. It is now clear that fine powder yields can be increased by the introduction of at least some non-axisymmetric effects such as non-axisymmetric melt flow.

While the systems and methods disclosed herein constitute preferred embodiments of the invention, it is to be understood that the invention is not limited to these precise systems and methods, and that changes may be made therein without departing from the scope of the invention which is defined in the appended claims.

What is claimed is:

1. A close-coupled atomization system for atomizing molten metal comprising:

plenum means having a channel therein for delivering at least one fluid; and a melt guide tube extending axially through the plenum to an exit orifice having a non-axisymmetric configuration, the plenum means including means for supporting the melt guide tube, the non-axisymmetric configuration of the melt guide tube exit orifice providing for the interaction of the delivered at least one fluid with the molten metal at a point proximate the melt guide tube exit orifice, said configuration of the melt guide tube exit orifice results in an interaction of the fluid and the non-axisymmetric molten metal such that about a five (5)% to about a thirteen (13)% positive variance in the fine powder yield is obtained as compared to a substantially similar system having axisymmetric fluid flow and an axisymmetric molten metal flow.

2. The system of claim 1 wherein the non-axisymmetric melt orifice configuration has a periphery dimension that is about at least 10% greater than that of a circle of equivalent area.

3. The system of claim 1 wherein the non-axisymmetric melt orifice configuration has a major axis which is about at least 30% greater than the minor axis.

4. The system of claim 1 wherein the non-axisymmetric configured melt guide tube exit orifice is configured so as to result in non-axisymmetric melt flow, defined as the condition existing at any time the periphery ratio (circumference of shape/circumference of circle) is greater than one (1.0) and melt is exiting the melt guide tube exit orifice.

5. The system of claim 1 wherein the non-axisymmetric configured melt guide tube exit orifice is configured so as to result in non-axisymmetric melt flow, defined as the condition existing when the axis of the melt orifice and the axis of the gas orifice are not concentric.

6. Apparatus for atomizing liquid metal comprising:

a liquid metal supply;

a fluid nozzle for atomizing a stream of liquid metal from the liquid metal supply in an atomization zone extending from the fluid nozzle; and a melt guide tube having an non-axisymmetric configured exit orifice, the non-axisymmetric configuration of the melt guide tube exit orifice providing for the interaction of the delivered at least one fluid with the molten metal at a point proximate the melt guide tube exit orifice, the melt guide tube exit orifice configuration resulting in an interaction of the fluid and the non-axisymmetric molten metal such that about a five (5)% to about a thirteen (13)% positive variance in the fine powder yield is obtained as compared to a substantially similar system having axisymmetric fluid flow and an axisymmetric molten metal flow.

7. The system of claim 6 wherein the non-axisymmetric melt orifice configuration has a periphery dimension that is about at least 10% greater than that of a circle of equivalent area.

8. The system of claim 6 wherein the non-axisymmetric melt orifice configuration has a major axis which is about at least 30% greater than the minor axis.

9. A system for the close-coupled atomization of liquid metal in an enclosure, the system comprising:

a crucible;

a fluid nozzle operatively positioned in the enclosure;

a melt guide tube operatively connected to the crucible and operatively positioned relative to the fluid nozzle;

a plenum, operatively connected to the fluid nozzle and operatively positioned relative the melt guide tube for providing at least one atomizing fluid to the fluid nozzle; and a non-axisymmetric configured melt guide tube exit orifice, operatively formed in the melt guide tube, for providing non-axisymmetric melt flow to interact with the at least one fluid at a point proximate the melt guide tube exit orifice, the melt guide tube exit orifice configuration resulting in an interaction of the fluid and the non-axisymmetric molten metal such that about a five (5)% to about a thirteen (13)% positive variance in the fine powder yield is obtained as compared to a substantially similar system having axisymmetric fluid flow and an axisymmetric molten metal flow.

10. The system of claim 9 wherein the melt exit orifice configuration has a periphery dimension that is about at least 10% greater than that of a circle of equivalent area.

11. The system of claim 9 wherein the melt exit orifice configuration has a major axis which is about at least 30% greater than the minor axis.

12. The system of claim 9 wherein the melt guide tube exit orifice is configured so as to result in non-axisymmetric melt flow, defined as the condition existing any time the periphery ratio (circumference of shape/circumference of circle) is greater than one (1) and melt is exiting the melt guide tube exit orifice.

13. The system of claim 9 wherein the melt guide tube exit orifice is configured so as to result in non-axisymmetric melt flow, defined as the condition existing when the axis of the melt orifice and the axis of the gas orifice are not concentric.

14. A close-coupled atomization system for atomizing molten metal comprising:

plenum means having a channel therein for delivering at least one fluid; and a melt guide tube extending axially through the plenum to an exit orifice, the exit orifice having a non-axisymmetric configuration, the plenum means including means for supporting the melt guide tube, the non-axisymmetric configuration of the melt guide tube exit orifice facilitating the interaction of the delivered at least one axisymmetric fluid with the molten metal at a point proximate the melt guide tube non-axisymmetric exit orifice, the melt guide tube exit orifice configuration resulting in an interaction of the fluid and the non-axisymmetric molten metal such that about a five (5)% to about a thirteen (13)% positive variance in the fine powder yield is obtained as compared to a substantially similar system having axisymmetric fluid flow and an axisymmetric molten metal flow.

15. The system of claim 14 wherein the non-axisymmetric melt orifice configuration has a periphery dimension that is about at least 10% greater than that of a circle of equivalent area.

16. The system of claim 14 wherein the non-axisymmetric melt orifice configuration has a major axis which is about at least 30% greater than the minor axis.

* * * * *